US009590365B2

(12) United States Patent
Yang et al.

(10) Patent No.: US 9,590,365 B2
(45) Date of Patent: Mar. 7, 2017

(54) CONNECTOR HOUSING

(71) Applicant: Tyco Electronics (Shanghai) Co. Ltd., Shanghai (CN)

(72) Inventors: Hongwen Yang, Shanghai (CN); Jian Zhou, Shanghai (CN); Weixiang Ding, Shanghai (CN); Yangrong Xue, Shanghai (CN); Jingwei Shao, Shanghai (CN); Xinbo Liu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 79 days.

(21) Appl. No.: 14/741,926

(22) Filed: Jun. 17, 2015

(65) Prior Publication Data

US 2015/0364870 A1 Dec. 17, 2015

(30) Foreign Application Priority Data

Jun. 17, 2014 (CN) ..... 2014 1 0269546

(51) Int. Cl.
*H01R 13/6587* (2011.01)
*H01R 13/659* (2011.01)

(52) U.S. Cl.
CPC ..... *H01R 13/659* (2013.01)

(58) Field of Classification Search
CPC ..... H01R 13/6587; H01R 13/6586; H01R 13/658; H05K 9/0058; H05K 9/002; H05K 9/0007; H05K 9/0083; H05K 9/0084; H05K 9/0088
USPC ..... 439/607.21, 607.2; 174/355, 390, 369, 174/385, 386, 50, 520, 535, 559–562, 174/356, 358, 377, 368; 361/704, 715, 361/729
See application file for complete search history.

(56) References Cited

U.S. PATENT DOCUMENTS 6,724,641 B1 * 4/2004 Hwang ..... G02B 6/4277 174/387
6,878,872 B2 * 4/2005 Lloyd ..... G02B 6/4277 174/366
7,612,299 B2 * 11/2009 Chen ..... H05K 9/0058 174/359
7,869,224 B1 * 1/2011 Yang ..... G02B 6/4284 174/350
8,182,290 B2 * 5/2012 Fonteneau ..... H05K 9/0058 439/607.21

(Continued)

*Primary Examiner* — Gary Paumen
(74) *Attorney, Agent, or Firm* — Barley Snyder

(57) ABSTRACT

The present invention discloses a connector housing comprising: an upper housing portion; a lower housing portion located below the upper housing portion; and at least three partition members located an inner space defined by the upper housing portion and the lower housing portion for partitioning the inner space into at least four insertion ports. At least one pair of the at least three partition members are connected to each other through a connecting plate so as to form a frame part in a general "⊔" shape; and the connecting plate is stacked onto a corresponding bottom of the lower housing portion. Thus, the amount of the partition members forming the connector housing is reduced, the structural strength of the entire connector housing may be increased, and a dimensional accuracy of each insertion port is reliably ensured.

14 Claims, 19 Drawing Sheets

(56) References Cited

U.S. PATENT DOCUMENTS

| | | | | |
|---|---|---|---|---|
| 8,203,084 | B2 * | 6/2012 | Wertz, Jr. | H01R 13/6584 174/368 |
| 8,426,751 | B2 * | 4/2013 | Lee | H01R 13/506 174/520 |
| 8,449,331 | B2 * | 5/2013 | Phillips | H01R 13/6581 361/704 |
| 8,613,632 | B1 * | 12/2013 | Nichols | H01R 13/6587 439/485 |
| 8,797,736 | B2 * | 8/2014 | Zhu | G06F 1/187 174/535 |
| 9,035,199 | B2 * | 5/2015 | Janota | H05K 9/0007 174/355 |
| 2004/0246693 | A1 * | 12/2004 | Lloyd | H01R 13/65802 361/800 |
| 2015/0072561 | A1 * | 3/2015 | Schmitt | H01R 13/6587 439/607.55 |

* cited by examiner

CONNECTOR HOUSING

CROSS-REFERENCE TO RELATED APPLICATIONS

This application claims the benefit of Chinese Patent Application No. 201410269546.7 filed on Jun. 17, 2014.

FIELD OF THE INVENTION

Embodiments of the present invention relate to a connector housing for outer shielding, in particular, to connector housing for outer shielding having multiple insertion ports.

BACKGROUND

FIG. 1 shows an exploded schematic view of a conventional connector housing, and FIG. 2 shows an assembled schematic view of the conventional connector housing.

As shown in FIGS. 1 and 2, the conventional connector housing comprises generally an upper housing portion 10, a lower housing portion 20 and a plurality of partition member 30.

In the prior art, as shown in FIGS. 1 and 2, the upper housing portion 10, the lower housing portion 20 and the partition members 30 are individual members separated from one another, and each partition member 30 is also an individual partition member.

As a whole, Fig. Fig. as for a housing having 1×N (N is an integer greater than 1) insertion ports, the number of the individual partition members is N+1, that is, there are too many partition members.

The connector housing (also referred as a connector cage or a connector shielding housing) has the upper housing portion 10, the lower housing portion 20 and the plurality of individual partition members 30 separated from one another in one layer and is formed with multi-ports configuration. The connector housing has poor structure strength, and thus inclines to crack integrally. Furthermore, since each port of the connector housing has a parallelogram configuration, and four side walls forming the parallelogram constitute separate four-parts configuration, it exhibits a parallelogram effect, i.e., the ports of the connector housing swing towards two sides of the connector housing. Also, it is hard to control fit dimension of members for assembling the connector housing. These factors cause that dimension of the ports of the connector housing cannot be ensured, and then cause that dimension of the ports of the connector housing is in a poor state. In addition, a rubber shield ring may be scratched due to sharp protrusions apt to be formed on the ports of the connector housing;

Furthermore, during manufacturing the connector housing, complex steps are required to assemble the upper housing 10, the lower housing 20 and the partition member 30, which are separated from one another, together, manufacturing efficiency is low, and it is hard to achieve efficient automatic machining process.

SUMMARY

It would be advantageous to provide a connector housing to reduce the number of the individual members constituting the connector housing.

It would also be advantageous to provide a connector housing with high strength and non-deformable ports.

According to an aspect of the present invention, provided is a connector housing comprising: an upper housing portion; a lower housing portion located below the upper housing portion; and at least three partition members located in an inner space defined by the upper housing portion and the lower housing portion to partition the inner space into at least four insertion ports; wherein at least one pair of the at least three partition members are connected to each other through a connecting plate to form a frame part in a general "| |" shape; and the connecting plate is stacked onto a corresponding position of a bottom of the lower housing portion.

According to an embodiment of the present invention, one partition member of the at least three partition members is integrally formed with the lower housing portion, and the frame part in the general "|_|" shape is an individual member.

According to an embodiment of the present invention, the upper housing portion and the lower housing portion are integrally formed by bending a single piece.

According to an embodiment of the present invention, each of the partition members has pins to be plugged into a circuit board for mounting the connector housing.

According to another embodiment of the present invention, the upper housing portion comprises: a first upper housing portion constructed to form a top wall of the connector housing; a pair of second upper housing portions constructed to form a pair of side walls of the connector housing; and a third upper housing portion constructed to form a rear end wall of the connector housing.

According to another embodiment of the present invention, the lower housing portion is constructed to form a bottom wall of the connector housing; the lower housing portion includes a first lower housing portion and a second lower housing portion connected with the pair of side walls of the upper housing portion, respectively; and one of the first and second lower housing portion is connected with one partition member.

According to another embodiment of the present invention, the pair of second upper housing portion constructed to form a pair of side walls of the connector housing both have pins to be plugged into the circuit board.

According to another embodiment of the present invention, the connector housing is entirely formed from a single piece of blank plate.

According to another embodiment of the present invention, the single piece of blank plate is shaped by one punching process.

According to another embodiment of the present invention, the connector housing comprises three partition members constructed to partition the inner space into four insertion ports; and two of the three partition members are formed as the frame part in the general "|_|" shape and the remained one is integrally formed with the lower housing portion.

According to another embodiment of the present invention, the connector housing comprises four partition members constructed to partition the inner space into five insertion ports; and the four partition members are forms as two frame parts in the general "|_|" shape.

According to another embodiment of the present invention, the connector housing comprises five partition members constructed to partition the inner space into six insertion ports; and two pairs of the five partition members are formed as two frame parts in the general "| |" shape and the remained one partition member is integrally formed with the lower housing portion.

According to another embodiment of the present invention, the connector housing comprises five partition members constructed to partition the inner space into six insertion ports; and two pairs of the five partition members are formed as two frame parts in the general "⊔" shape and the remained one partition member is integrally formed with the lower housing portion.

According to another embodiment of the present invention, the connector housing comprises N insertion ports, wherein N is an uneven number being equal to or greater than 5, and the connector housing comprises (N−1) partition members constructed to form (N−1)/2 frame parts.

In the above embodiment of the present invention, at least one pair of the plurality of partition members are connected to each other to form an individual part in a "⊔" shape, the amount of the partition members forming the connector housing is reduced, so that the structural strength of the entire connector housing may be increased, a dimensional accuracy of each insertion port is thus reliably ensured. Moreover, the connector housing of the present invention can be formed by a single piece of blank plate, thus, the manufacture and assembling steps are reduced, the manufacture efficiency is improved and the manufacture cost is reduced.

Other objectives and advantages of the present invention will become more apparent by describing the present invention with reference to the accompanying drawings in the following, it may also aid to give a complete comprehension of the present invention.

DETAILED DESCRIPTION OF THE EMBODIMENT(S)

The technical solutions of the present invention are further explained specifically in the following by embodiments and in combination with accompanying drawings. The same or similar reference numbers indicate the same or similar parts in the description. The following explanation of the embodiments of the present invention with reference to the drawings intends to explain the general inventive concept of the present invention, but cannot be interpreted as a limitation to the present invention.

Moreover, in the following detailed description, for the purpose of explanation, a number of specific details are explained in order to provide a complete comprehension to the disclosed embodiments. However, it is obvious that one or more embodiments may be implemented without these specific details. In other cases, well known structures and devices are embodied in a form of illustration to simplify the drawings.

According to a general technical concept of the present invention, provided is a connector housing comprising: an upper housing portion; a lower housing portion located below the upper housing portion; and at least three partition members located an inner space defined by the upper housing portion and the lower housing portion to partition the inner space into at least four insertion ports; wherein at least one pair of the at least three partition members are connected to each other through a connecting plate so as to form a frame part in a general "⊔" shape; and the connecting plate is stacked onto a corresponding position of a bottom of the lower housing portion.

A First Embodiment

Figure 1:
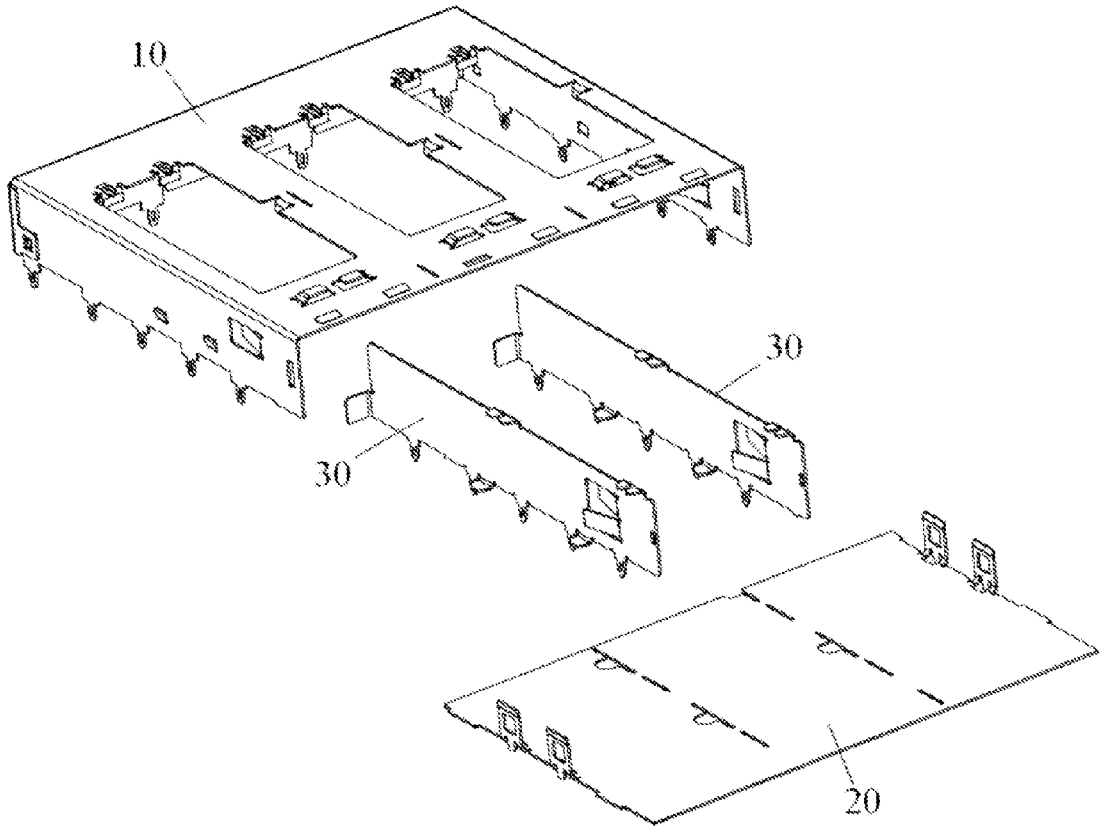
FIG. 1 shows an exploded schematic view of a conventional connector housing.
Figure 2:
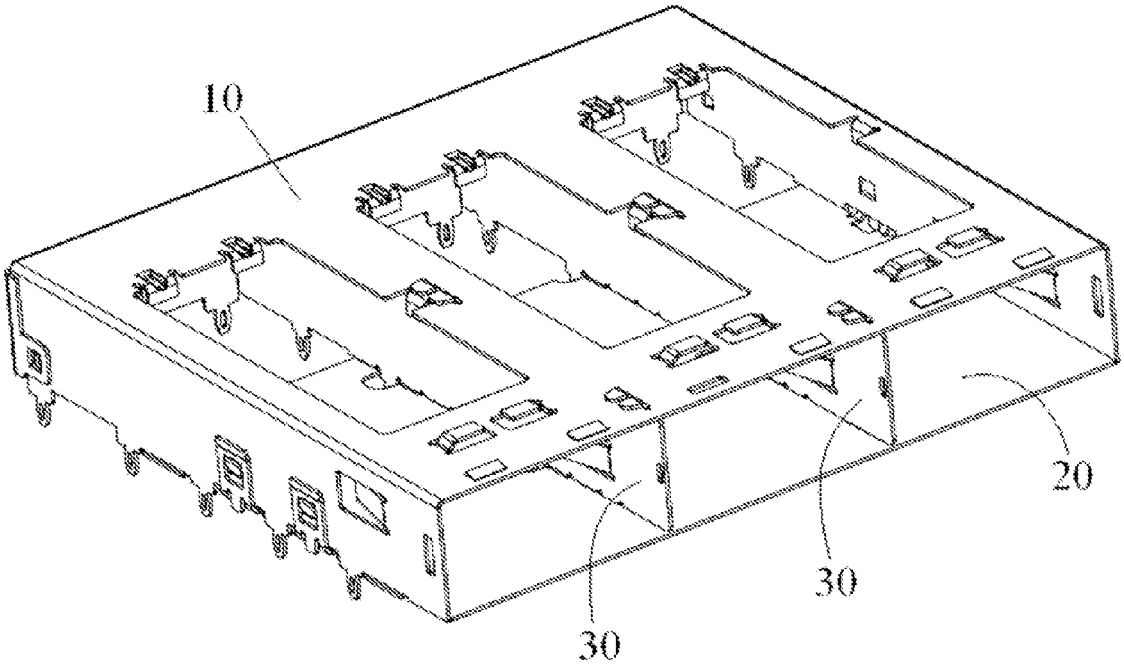
FIG. 2 shows an assembled schematic view of the conventional connector housing.
Figure 3A:
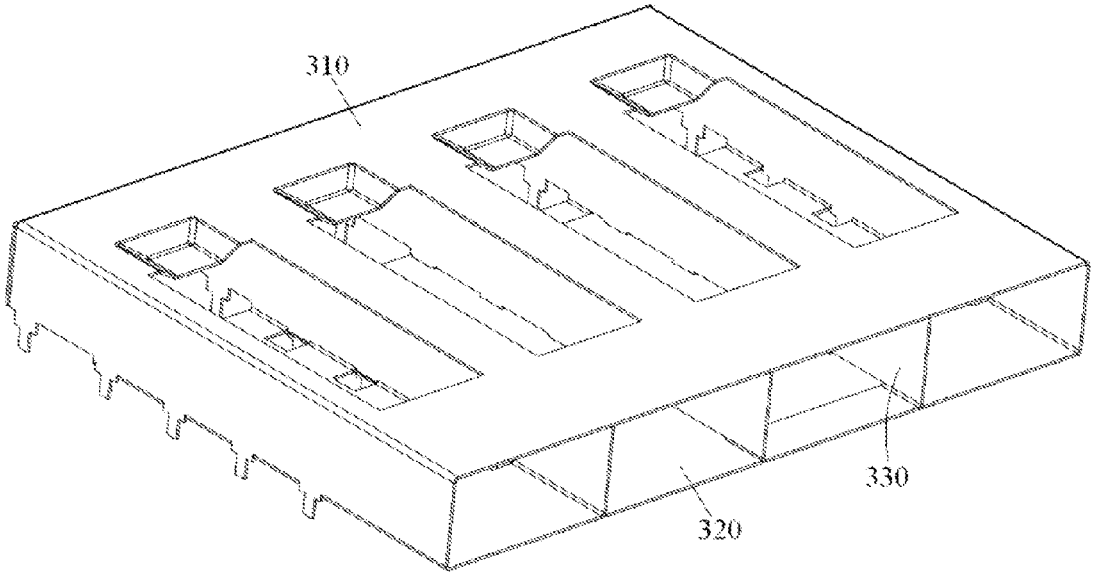
FIG. 3*a* shows an assembled schematic view of a connector housing having four insertion ports according to a first embodiment of the present invention.

FIG. 3*a* shows an assembled schematic view of a connector housing having four insertion ports according to a first embodiment of the present invention.

As shown in FIG. 3*a*, in the illustrated embodiment, the connector housing mainly comprises an upper housing portion 310, a lower housing portion 320 and three partition members 330.

As shown in FIG. 3*a*, the lower housing portion 320 is located below the upper housing portion 310. An inner space is defined between the upper housing portion 310 and the lower housing portion 320, and the three partition members 330 are located in the inner space to partition the inner space into four insertion ports which are arranged side by side in a longitudinal direction parallel to a bottom wall or a top wall of the connector housing.

Figure 3B:
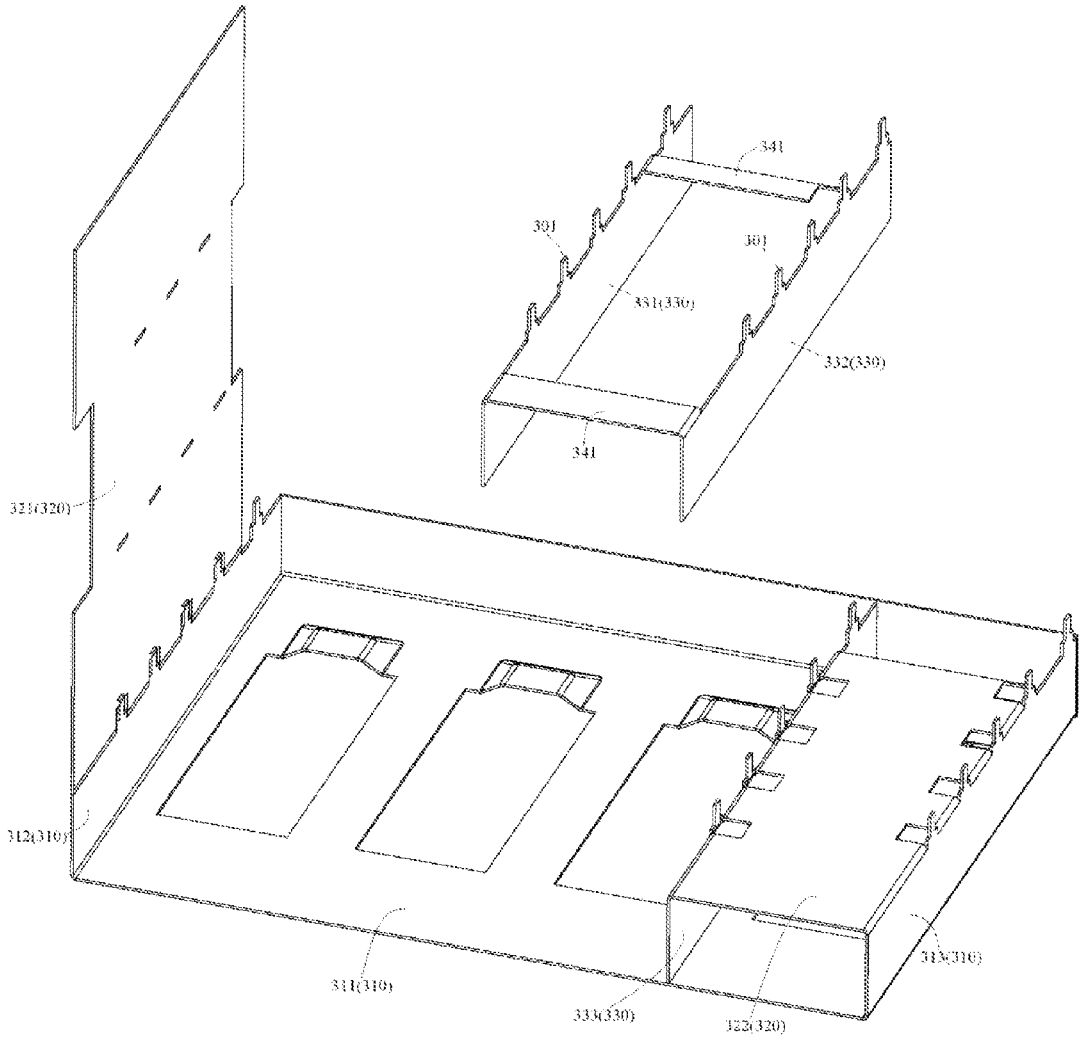
FIG. 3*b* shows an exploded schematic view of the connector housing having four insertion ports according to the first embodiment of the present invention.

FIG. 3*b* shows an exploded schematic view of the connector housing having four insertion ports according to the first embodiment of the present invention. And FIG. 4 shows a plane expanded schematic view of the connector housing having four insertion ports according to the first embodiment of the present invention.

Figure 4:
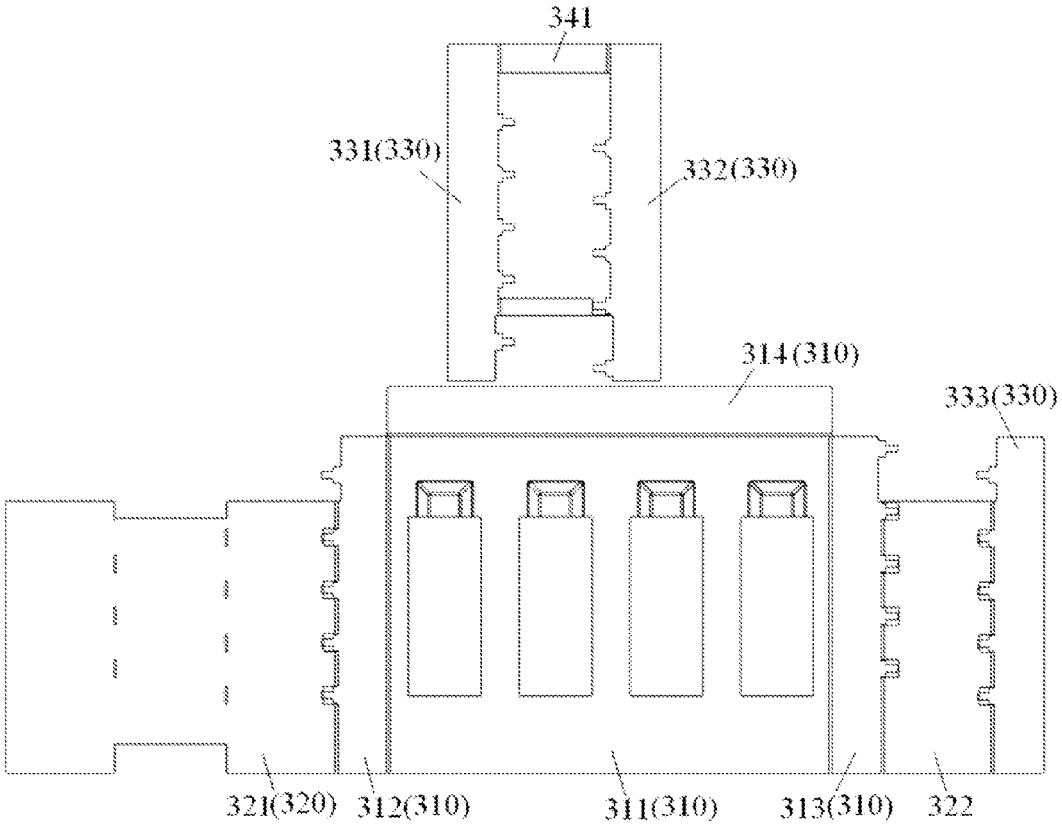
FIG. 4 shows a plane expanded schematic view of the connector housing having four insertion ports according to the first embodiment of the present invention.

As shown in FIG. 3*b* and FIG. 4, the entire upper housing portion 310 and the entire lower housing portion 320 are integrally formed as a single piece in the illustrated embodiment.

As shown in FIGS. 3*b* and 4, in the illustrated embodiment, two partition members 331, 332 of the three partition members 331, 332, 333 are individual members separated from the upper housing portion 310 and the lower housing portion 320 and are connected with each other through a connecting plate 341 to form a single piece.

Figure 6:
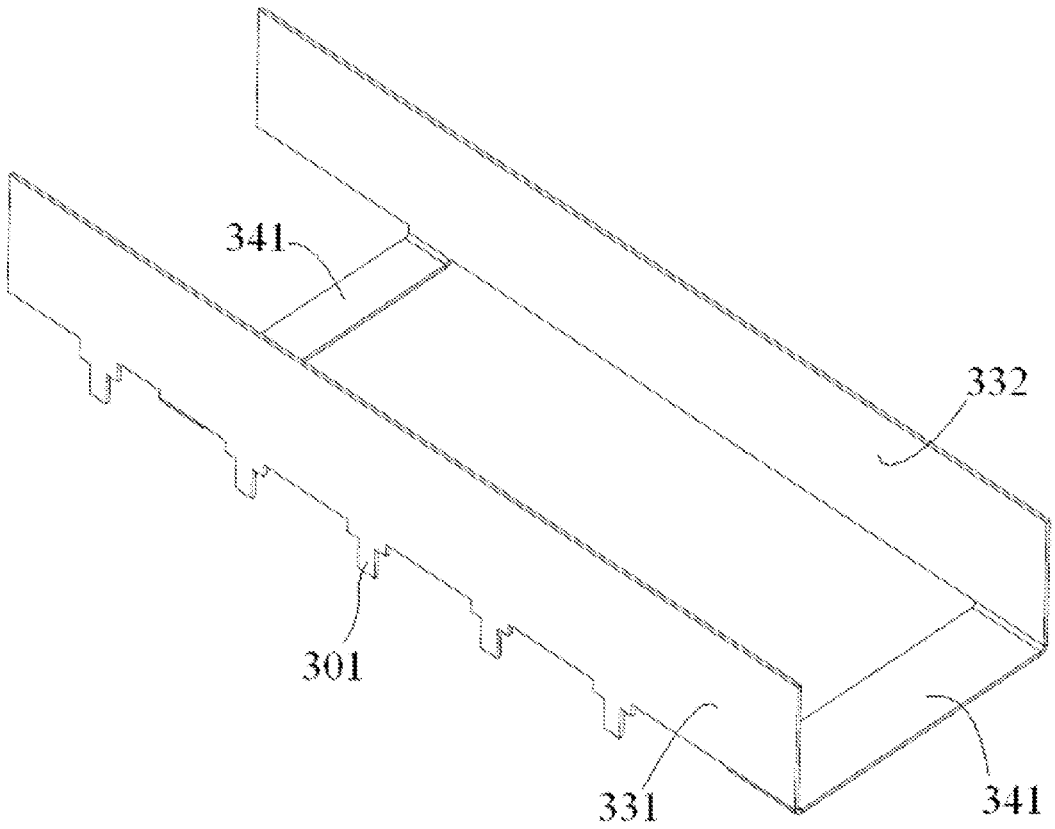
FIG. 6 shows a perspective schematic view of a frame part formed by a pair of partition members shown in FIG. 4.

FIG. 6 shows a perspective schematic view of a frame part formed by a pair of partition members 331, 332 shown in FIG. 4.

As shown in FIGS. 3*b*, 4 and 6, two partition members 331, 332 are connected with each other through the connecting plate 341 to form a frame part with a section in a general "| |" shape. As such, two separated partition members 331, 332 are connected to form a single piece, so that the quantity of the partition members consisting of the connector housing is reduced and the entire strength of the connector housing is improved.

Referring to FIGS. 3*a*, 3*b*, 4 and 6, the connecting plate 341 is stacked on a corresponding position of an inner bottom of the lower housing portion 320 when the "⊔" shaped part as shown in FIG. 6 is placed in the inner space between the upper housing portion 310 and the lower housing portion 320, thereby a partial thickness of the lower housing portion 320 is increased, and a partial strength of the lower housing portion 320 is also increased.

As shown in FIGS. 3*a*, 3*b*, 4 and 6, the two partition members 331, 332 separated from the upper housing portion 310 and the lower housing portion 320 both have pins 301, the pins 301 are inserted through corresponding slits formed in the lower housing portion 320 and are plugged into a circuit board (not shown) for mounting the connector housing.

Referring to FIGS. 3*a*, 3*b* and 4, in the illustrated embodiment, one remained partition member 333 of the three partition members 331, 332, 333 is formed as a single piece integrated with the lower housing portion 320.

Figure 5:
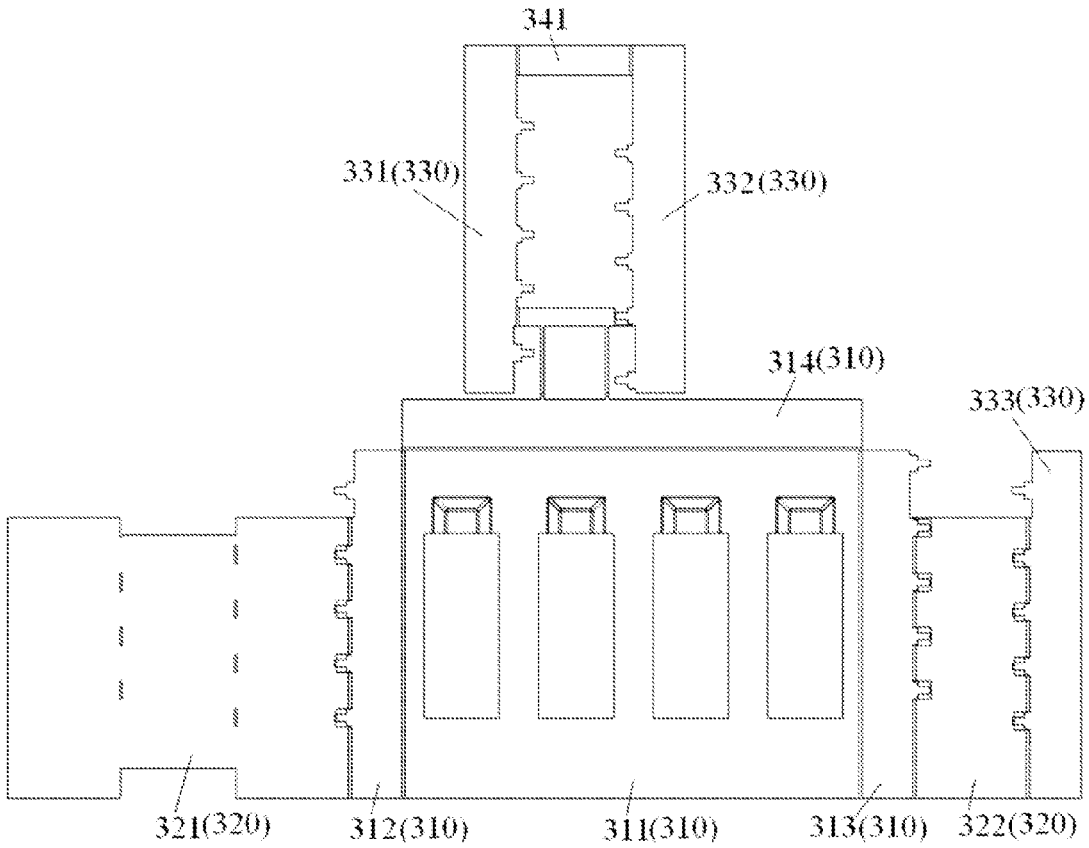
FIG. 5 shows a schematic view of a blank plate for forming the connector housing shown in FIG. 3*a;*

FIG. 5 shows a schematic view of a blank plate for forming the connector housing shown in FIG. 3*a* and FIG. 3*b*.

In an embodiment of the present invention, as shown in FIG. 5, a main part of the entire connector housing may be formed from a single piece of blank plate, and the single piece of blank plate may be shaped by one punching processing, that is, the structures forming the connector housing, such as the upper housing portion 310, the lower housing portion 320 and a partition member 333, may be formed by performing one punching processing on a single piece of blank plate in one time.

In the embodiment as shown in FIGS. 3*a* to 6, the entire upper housing portion 310, the entire lower housing portion 320 and the partition member 333 are formed as an integral part, thus, simplifying manufacture and assembling steps, achieving high degree of automation, facilitating a mass production, and improving a manufacture efficiency. Meanwhile, the structural strength of the entire connector housing is very high and the stability thereof is good because the entire upper housing portion 310, the entire lower housing portion 320 and the partition member 333 are integrally formed as a single piece, a dimensional accuracy of each port is thus ensured.

Also referring to FIGS. 3*a* to 6, the upper housing portion 310 comprises: a first upper housing portion 311 for forming a top wall of the connector housing, a pair of second upper housing portions 312, 313 for forming a pair of side walls of the connector housing, and a third upper housing portion 314 for forming a rear end wall of the connector housing.

Also referring to FIGS. 3*a* to 6, the lower housing portion 320 is constructed to form a bottom wall of the connector housing. In the illustrated embodiment, the lower housing portion 320 comprises a first lower housing portion 321 and a second lower housing portion 322 connected with the pair of second upper housing portions 312 and 313, respectively. The first and second lower housing portions 321 and 322 are formed as a single piece integrated part with the entire upper housing portion 310.

Also referring to FIGS. 3*a* to 6, in the illustrated embodiment, the one partition member 333 is integrally connected to the second lower housing portion 322 and forms a single piece.

A Second Embodiment

Figure 7A:
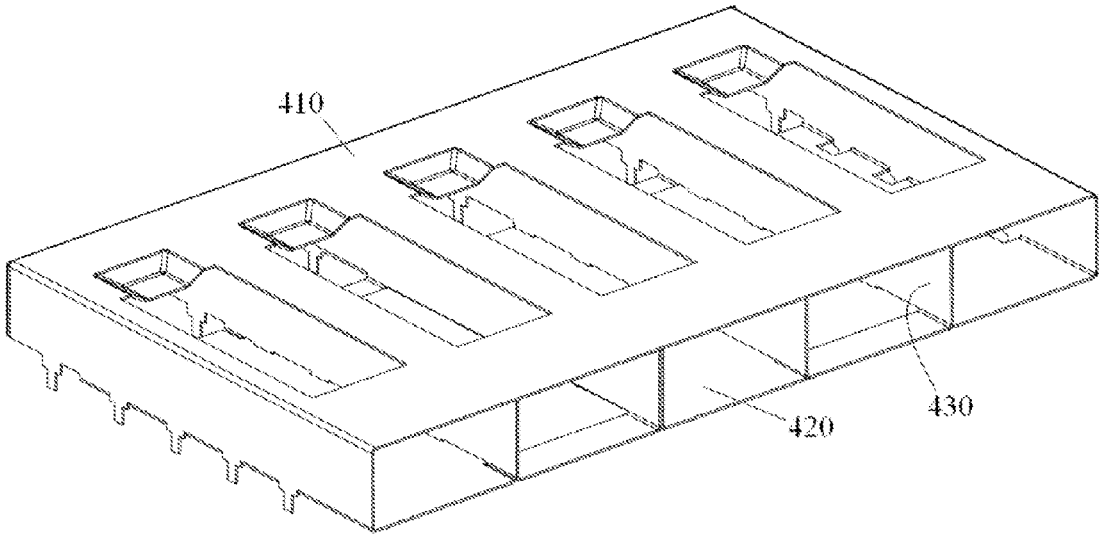
FIG. 7*a* shows an assembled schematic view of a connector housing having five insertion ports according to a second embodiment of the present invention.

FIG. 7*a* shows an assembled schematic view of a connector housing having five insertion ports according to a second embodiment of the present invention.

As shown in FIG. 7*a*, the connector housing mainly comprises an upper housing portion 410, a lower housing portion 420 and four partition members 430 in the illustrated embodiment.

Figure 7B:
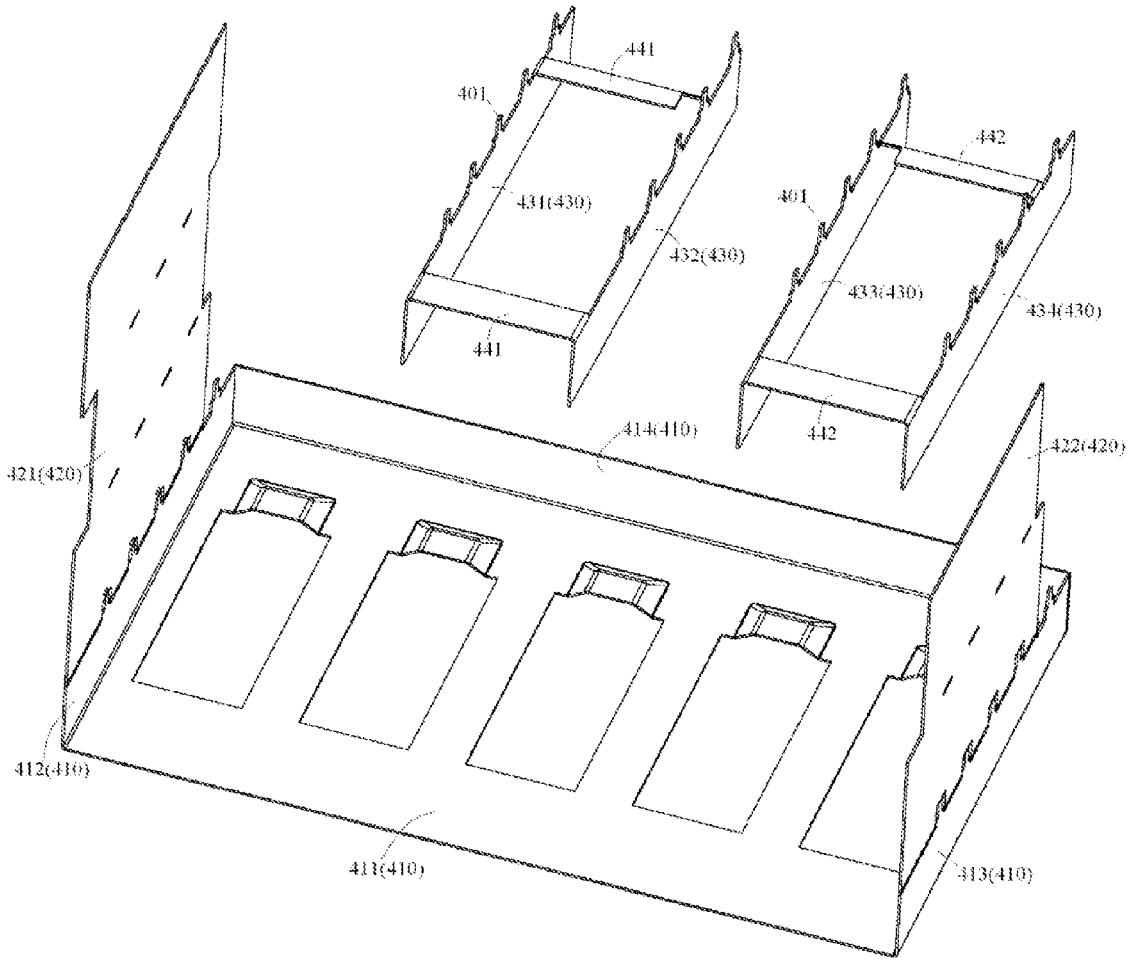
FIG. 7*b* shows an exploded schematic view of the connector housing having five insertion ports according to the second embodiment of the present invention.

FIG. 7*b* shows an exploded schematic view of the connector housing having five insertion ports according to the second embodiment of the present invention. And FIG. 8 shows a plane expanded schematic view of the connector housing having five insertion ports according to the second embodiment of the present invention.

Figure 8:
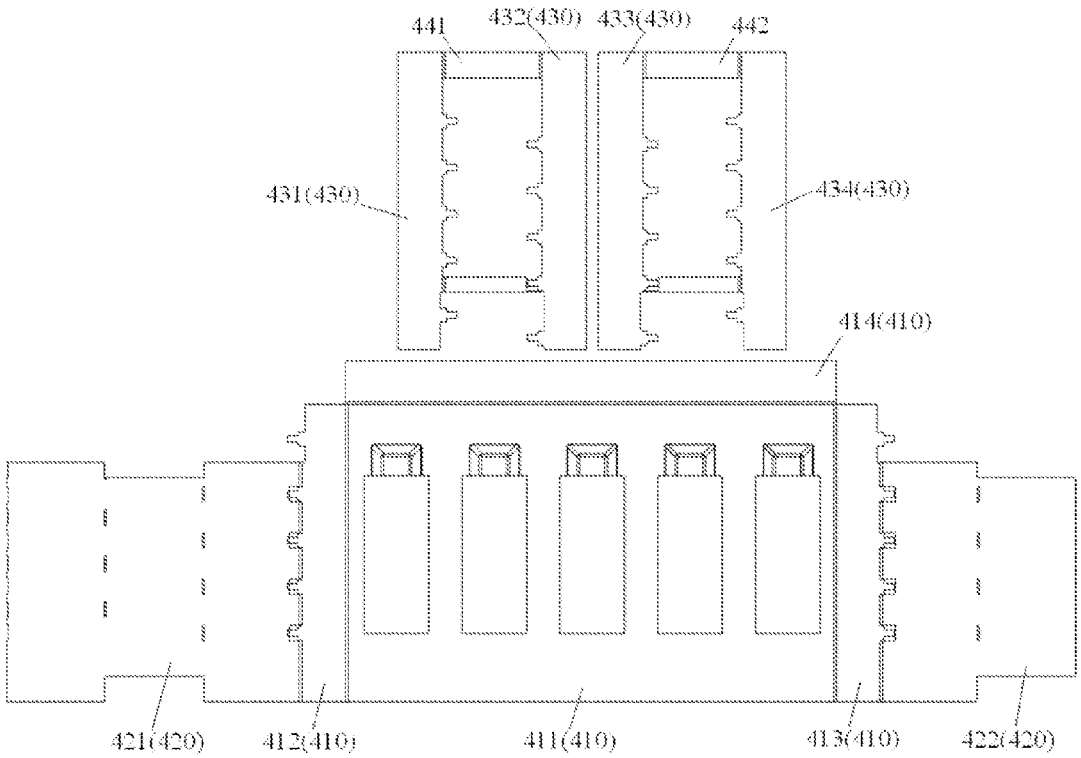
FIG. 8 shows a plane expanded schematic view of the connector housing having five insertion ports according to the second embodiment of the present invention.

As shown in FIGS. 7*a*, 7*b* and 8, the illustrated four partition members 431, 432, 433, 434 have pins 401.

As shown in FIG. 7*a*, the lower housing portion 420 is located below the upper housing portion 410. An inner space is defined between the upper housing portion 410 and the lower housing portion 420, and the four partition members 430 are located in the inner space and constructed to partition the inner space into five insertion ports which are arranged in a row in a longitudinal direction parallel to a bottom wall or a top wall of the connector housing.

As shown in FIGS. 7*a*, 7*b* and 8, the entire upper housing portion 410 and the entire lower housing portion 420 are integrally formed as a single piece in the illustrated embodiment.

As shown in FIGS. 7*b* and 8, in the illustrated embodiment, the four partition members 431, 432, 433, 434 are individual members separated from the upper housing portion 410 and the lower housing portion 420. Two partition members 431, 432 separated from the upper housing portion 410 and the lower housing portion 420 are connected with each other through a connecting plate 441 to form a single piece, and two partition members 433, 434 separated from the upper housing portion 410 and the lower housing portion 420 are connected with each other through a connecting plate 442 to form a single piece.

Figure 10A:
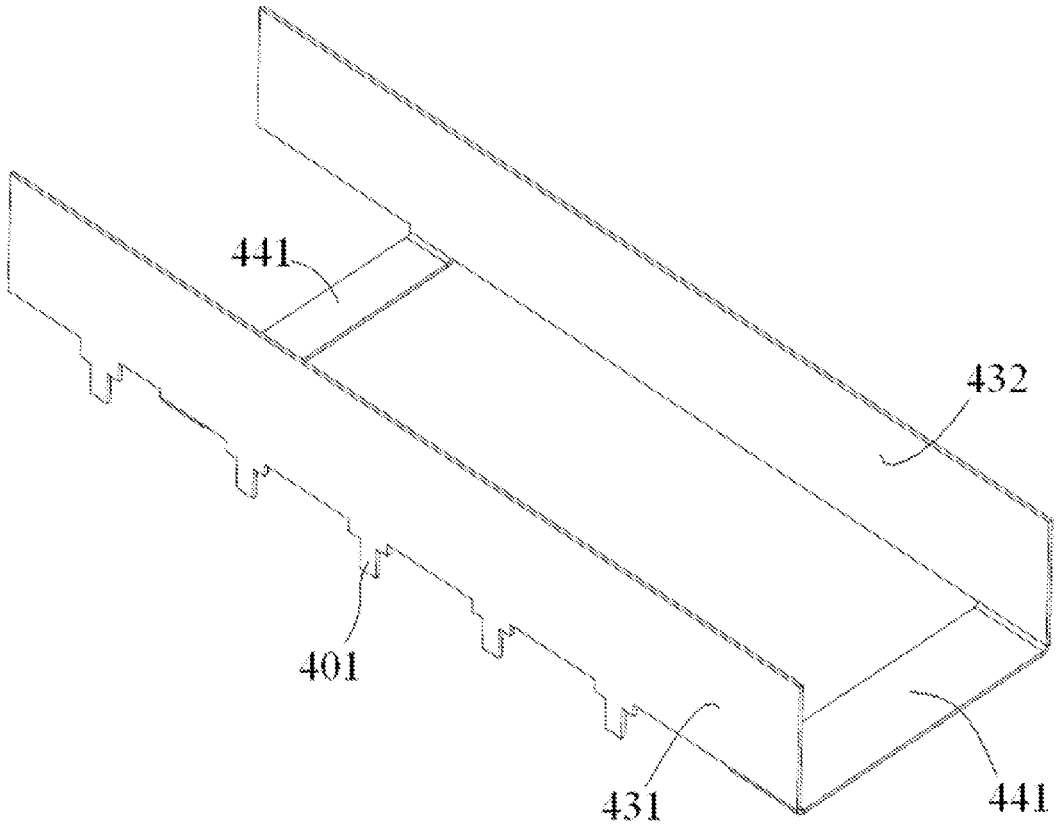
FIG. 10*a* shows a perspective schematic view of a frame part formed by a pair of partition members shown in FIG. 8.
Figure 10B:
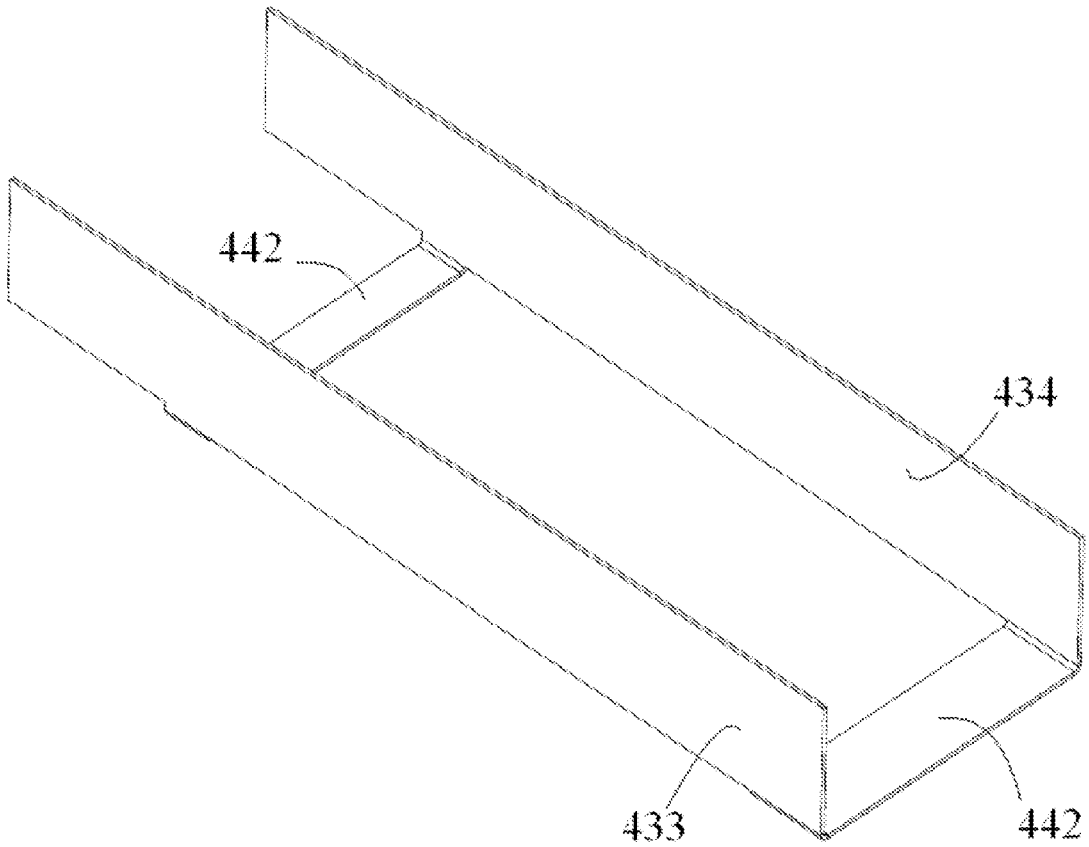
FIG. 10*b* shows a perspective schematic view of a frame part formed by another pair of partition members shown in FIG. 8.

FIG. 10*a* shows a perspective schematic view of a frame part formed by a pair of partition members 431, 432 shown in FIG. 8; FIG. 10*b* shows a perspective schematic view of a frame part formed by a pair of partition members 433, 434 shown in FIG. 8.

As shown in FIGS. 7*a*, 7*b*, 8 and 10*a*, the two partition members 431, 432 are connected with each other through the connecting plate 441 to form a frame part in a general "⊔" shape. As such, the two separated partition members 431, 432 are connected to form a single piece, so that the quantity of the partition members consisting of the connector housing is reduced and the entire strength of the connector housing is improved.

Referring to FIGS. 7*a*, 7*b*, 8 and 10*a*, the connecting plate 441 is stacked on a corresponding position of an inner bottom of the lower housing portion 420 when the "⊔" shaped part as shown in FIG. 10*a* is placed in the inner space between the upper housing portion 410 and the lower housing portion 420. In this way, a partial thickness of the lower housing portion 420 may be increased, and a partial strength of the lower housing portion 420 may also be increased.

As shown in FIGS. 7*a*, 7*b*, 8 and 10*b*, the two partition members 433, 434 are connected with each other through the connecting plate 442 to form a frame part in a general "⊔" shape. As such, the two separated partition members 433, 434 are connected to form a single piece, so that the entire strength of the connector housing is improved.

As shown in FIGS. 7*a*, 7*b*, 8 and 10*b*, the connecting plate 442 is stacked on a corresponding position of the inner bottom of the lower housing portion 420 when the "| |" shaped part as shown in FIG. 10*b* is placed in the inner space between the upper housing portion 410 and the lower housing portion 420. In this way, a partial thickness of the lower housing portion 420 may be increased, and a partial strength of the lower housing portion 420 may also be increased.

As shown in FIGS. 7*a*, 7*b*, 8, 10*a* and 10*b*, the four partition members 431, 432, 433, 434 separated from the upper housing portion 410 and the lower housing portion 420 have pins 401, which are inserted through corresponding slits formed in the lower housing portion 420 and are plugged into a circuit board for mounting the connector housing.

Figure 9:
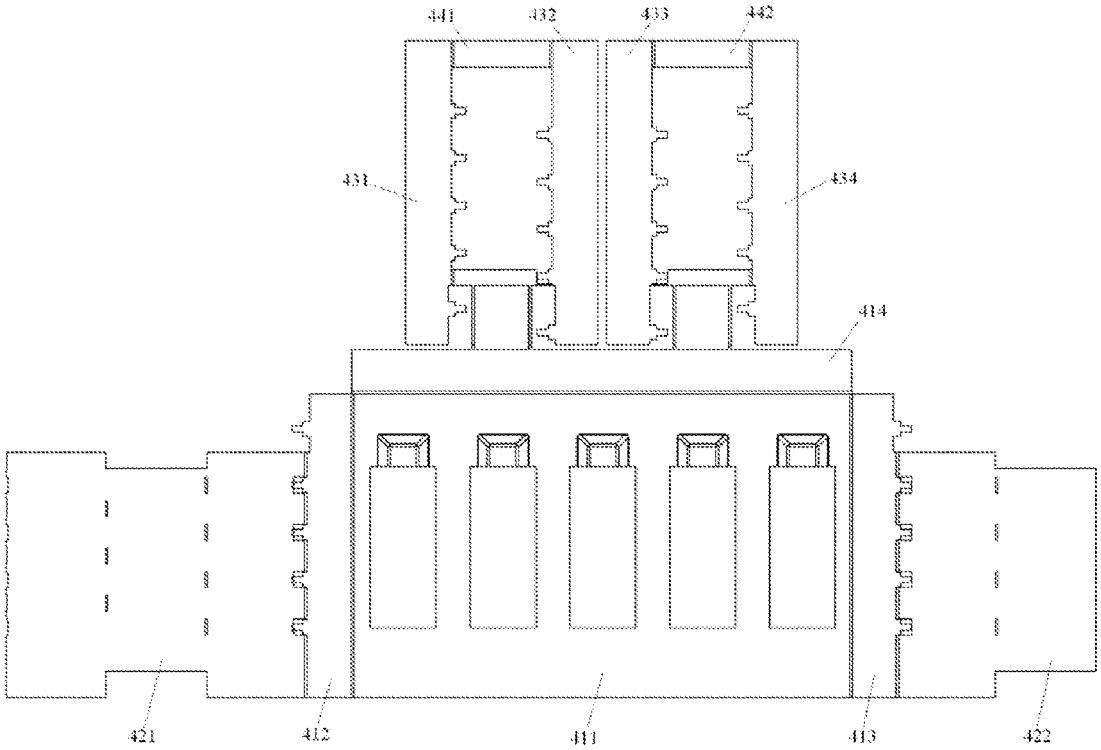
FIG. 9 shows a schematic view of a blank plate for forming the connector housing shown in FIG. 7*a;*

FIG. 9 shows a schematic view of a blank plate for forming the connector housing shown in FIG. 7*a* and FIG. 7*b*.

In an embodiment of the present invention, as shown in FIG. 9, the entire connector housing may be formed from a single piece of blank plate, the single piece of blank plate may be shaped by one punching processing, that is, the structures forming the connector housing, such as the upper housing portion 410, the lower housing portion 420 and a partition member 430, may be formed by performing one punching processing on the single piece of blank plate in one time.

In the embodiment as shown in FIGS. 7*a* to 9, the entire upper housing portion 410 and the entire lower housing portion 420 are formed as a single piece, thus, simplifying manufacture and assembling steps, achieving a high degree of automation, facilitating a mass production, and improving manufacture efficiency. Meanwhile, the structural strength of the entire connector housing is very high and the stability thereof is good because the entire upper housing portion 410, the entire lower housing portion 420 and the partition member 430 are integrally formed as a single piece, a dimensional accuracy of each port is thus ensured.

Also referring to FIGS. 7*a* to 9, the upper housing portion 410 comprises: a first upper housing portion 411 for forming a top wall of the connector housing, a pair of second upper housing portion 412, 413 for forming a pair of side walls of the connector housing, and a third upper housing portion 414 for forming a rear end wall of the connector housing.

Also referring to FIGS. 7*a* to 9, the lower housing portion 420 is used to form a bottom wall of the connector housing. In the illustrated embodiment, the lower housing portion 420 comprises a pair of first lower housing portion 421 and second lower housing portion 422 connected with the pair of second upper housing portion 412, 413 of the upper housing portion, respectively. The first and second lower housing portion 421, 422 are integrally formed with the entire upper housing portion 410.

A Third Embodiment

Figure 11A:
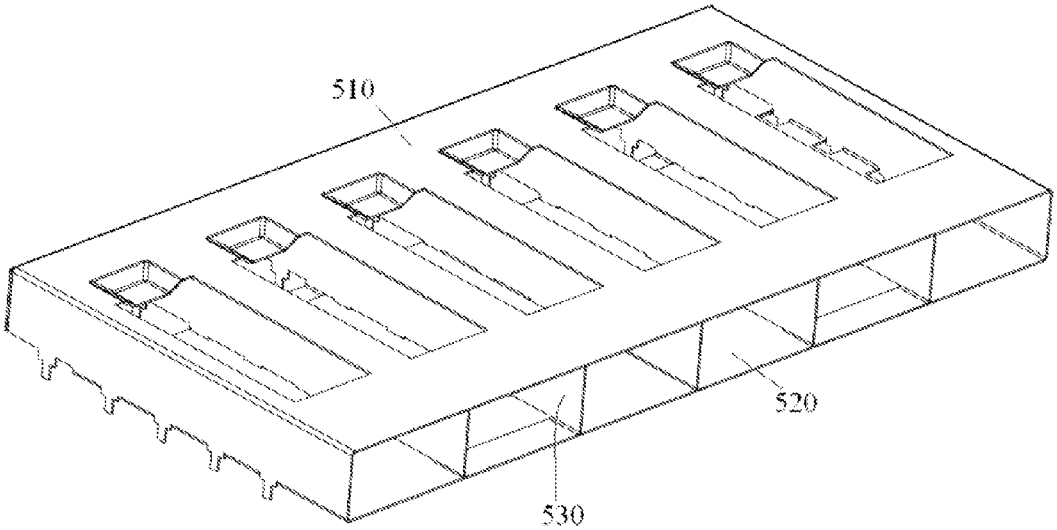
FIG. 11*a* shows an assembled schematic view of a connector housing having six insertion ports according to a third embodiment of the present invention.

FIG. 11*a* shows an assembled schematic view of a connector housing having six insertion ports according to a third embodiment of the present invention.

As shown in FIG. 11*a*, the connector housing mainly comprises an upper housing portion 510, a lower housing portion 520 and five partition members 530 in the illustrated embodiment.

As shown in FIG. 11*a*, the lower housing portion 520 is located below the upper housing portion 510. An inner space is defined between the upper housing portion 510 and the lower housing portion 520, and the five partition members 530 are located in the inner space and constructed to partition the inner space into six insertion ports which are arranged in a row in a longitudinal direction parallel to a bottom wall or a top wall of the connector housing.

Figure 11B:
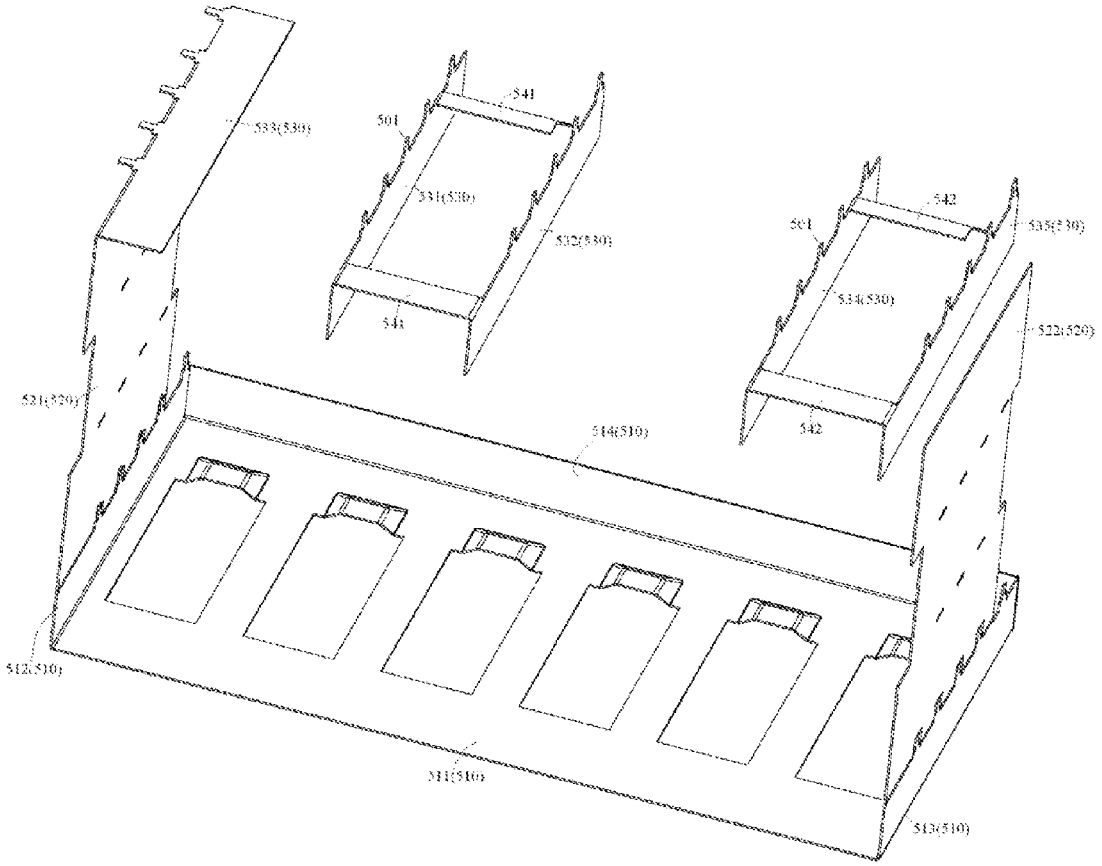
FIG. 11*b* shows an exploded schematic view of the connector housing having six insertion ports according to the third embodiment of the present invention.

FIG. 11*b* shows an exploded schematic view of the connector housing having six insertion ports according to the third embodiment of the present invention. And FIG. 12 shows a plane expanded schematic view of the connector housing having six insertion ports according to the third embodiment of the present invention.

Figure 12:
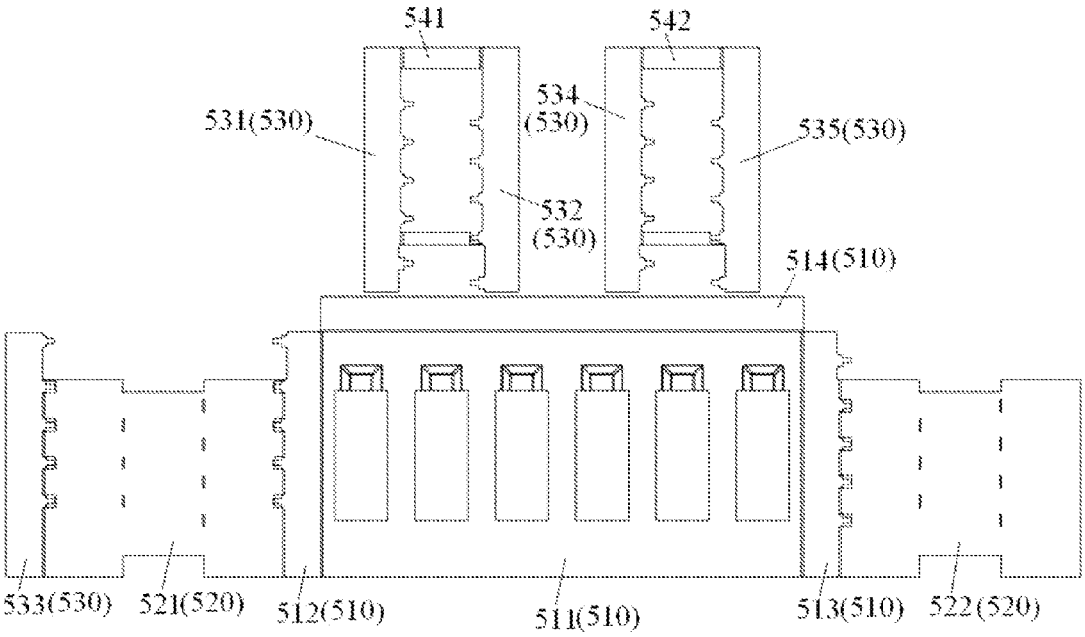
FIG. 12 shows a plane expanded schematic view of the connector housing having six insertion ports according to the third embodiment of the present invention.

As shown in FIG. 11*b* and FIG. 12, the entire upper housing portion 510 and the entire lower housing portion 520 are integrally formed as a single piece in the illustrated embodiment.

As shown in FIG. 12, in the illustrated embodiment, four partition members 531, 532, 534, 535 of the five partition members 531, 532, 533, 534, 535 are individual members separated from the upper housing portion 510 and the lower housing portion 520. Two partition members 531, 532 separated from the upper housing portion 510 and the lower housing portion 520 are connected with each other through a connecting plate 541 to form a single piece, and two partition members 534, 535 separated from the upper housing portion 510 and the lower housing portion 520 are connected with each other through a connecting plate 542 to form a single piece.

Figure 14A:
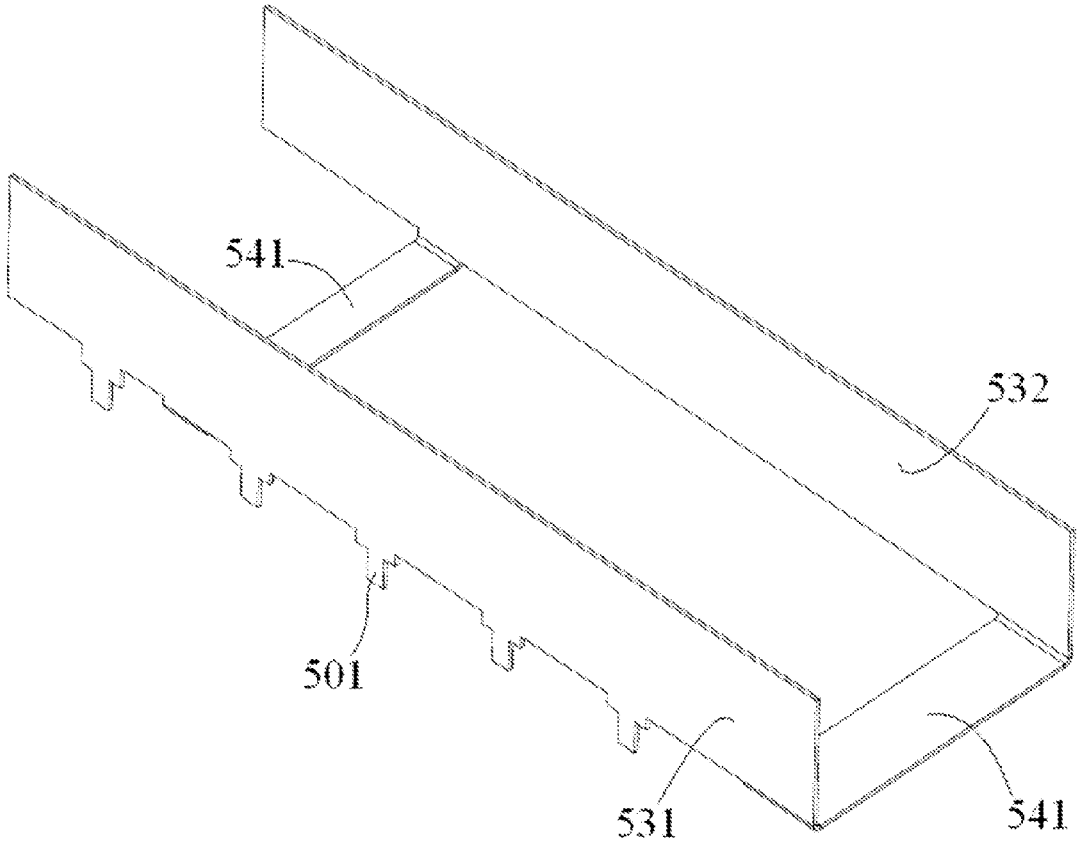
FIG. 14*a* shows a perspective schematic view of a frame part formed by a pair of partition members shown in FIG. 12.

FIG. 14*a* shows a perspective schematic view of a frame part formed by a pair of partition members 531, 532 shown in FIG. 12.

As shown in FIGS. 11*b*, 12 and 14*a*, the two partition members 531, 532 are connected with each other through the connecting plate 541 to form a frame part in a general "⊔" shape. As such, the two separated partition members 531, 532 are connected to form a single piece, so that the quantity of the partition members consisting of the connector housing is reduced and the entire strength of the connector housing is improved.

Referring to FIGS. 11*a*, 11*b*, 12 and 14*a*, the connecting plate 541 is stacked on a corresponding position of an inner bottom of the lower housing portion 520 when the "| |"

shaped part as shown in FIG. 14*a* is placed in the inner space between the upper housing portion 510 and the lower housing portion 520. In this way, a partial thickness of the lower housing portion 520 may be increased, and a partial strength of the lower housing portion 520 may also be increased.

Figure 14B:
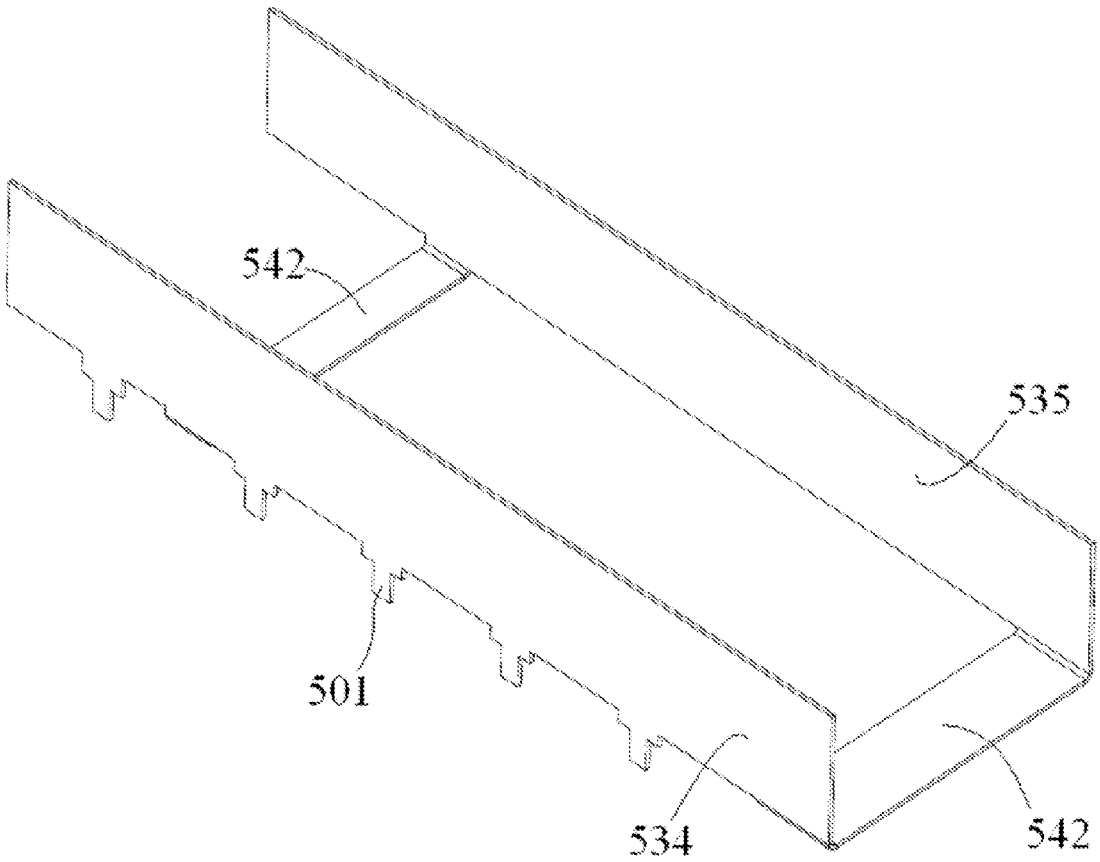
FIG. 14*b* shows a perspective schematic view of a frame part formed by another pair of partition members shown in FIG. 12.

FIG. 14*b* shows a perspective schematic view of a frame part formed by another pair of partition members 534, 535 shown in FIG. 12.

As shown in FIGS. 11*b*, 12 and 14*b*, the two partition members 534, 535 are connected with each other through the connecting plate 542 to form a frame part in a general "⊔" shape. As such, the two separated partition members 534, 535 are connected to form a single piece, so that the quantity of the partition members consisting of the connector housing is reduced and the entire strength of the connector housing is improved.

Referring to FIGS. 11*a*, 11*b*, 12 and 14*a*, the connecting plate 542 is stacked on a corresponding position of the inner bottom of the lower housing portion 520 when the "| |" shaped part as shown in FIG. 14*b* is placed in the inner space between the upper housing portion 510 and the lower housing portion 520. In this way, a partial thickness of the lower housing portion 520 may be increased, and a partial strength of the lower housing portion 520 may also be increased.

As shown in FIGS. 11*a*, 11*b*, 12, 14*a* and 14*b*, the four partition members 531, 532, 534, 535 separated from the upper housing portion 510 and the lower housing portion 520 have pins 501, the pins 501 are inserted through corresponding slits formed in the lower housing portion 520 and are plugged into a circuit board for mounting the connector housing.

Referring to FIGS. 11*a*, 11*b* and 12, in the illustrated embodiment, one remained partition member 533 of the five partition members 531, 532, 533, 534, 535 is integrally formed with the lower housing portion 520.

Figure 13:
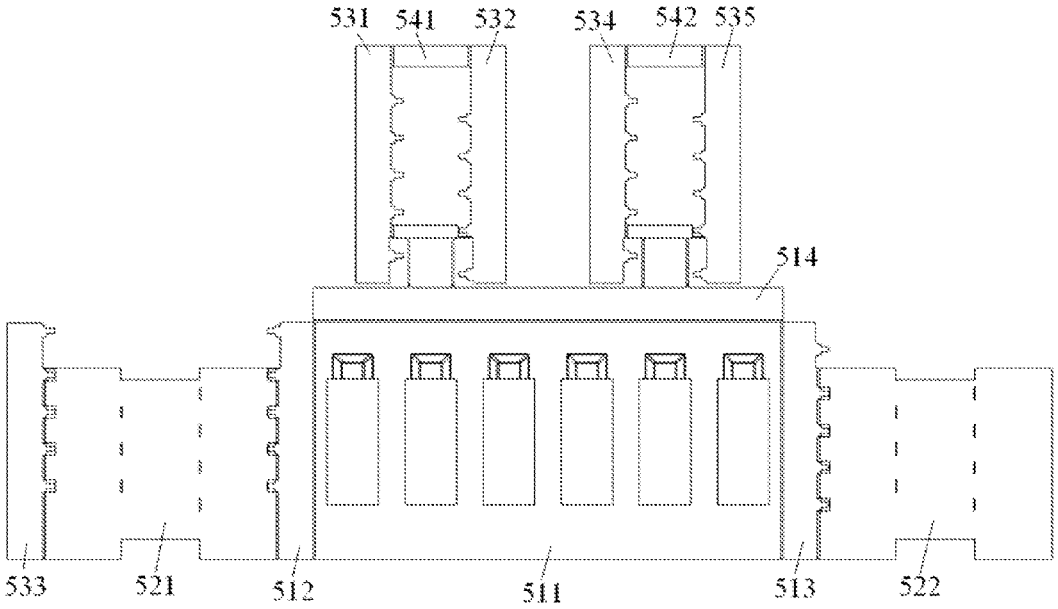
FIG. 13 shows a schematic view of a blank plate for forming the connector housing shown in FIG. 11*a;*

FIG. 13 shows a schematic view of a blank plate for forming the connector housing shown in FIG. 11*a*.

In an embodiment of the present invention, as shown in FIG. 13, the entire connector housing may be formed from a single piece of blank plate, the single piece of blank plate may be shaped by one punching processing, that is, the structures forming the connector housing, such as the upper housing portion 510, the lower housing portion 520 and partition members 530, may be formed by performing one punching processing on the single piece of blank plate in one time.

In the embodiment as shown in FIGS. 11*a* to 13, the entire upper housing portion 510, the entire lower housing portion 520 and the partition member 533 are formed as a single piece, thus, simplifying manufacture and assembling steps, achieving a high degree of automation, facilitating a mass production, and facilitating a manufacture efficiency. Meanwhile, the structural strength of the entire connector housing is very high and the stability thereof is good because the entire upper housing portion 510, the entire lower housing portion 520 and the partition member 533 are integrally formed as a single piece, a dimensional accuracy of each port is thus ensured.

Also referring to FIGS. 11*a* to 13, the upper housing portion 510 comprises: a first upper housing portion 511 for forming a top wall of the connector housing, a pair of second upper housing portion 521, 513 for forming a pair of side walls of the connector housing, and a third upper housing portion 514 for forming a rear end wall of the connector housing.

Also referring to FIGS. 11*a* to 13, the lower housing portion 520 is used to form a bottom wall of the connector housing. In the illustrated embodiment, the lower housing portion 520 comprises a pair of first lower housing portion 521 and second lower housing portion 522 connected with the pair of second upper housing portion 512, 513, respectively. The first and second lower housing portion 521, 522 are integrally formed with the entire upper housing portion 510.

Also referring to FIGS. 11*a* to 13, in the illustrated embodiment, one partition member 533 is integrally connected to the first part 521 of the lower housing portion and forms a single piece therewith. According to an embodiment of the present invention, the connector housing comprises N insertion ports, wherein N is an even number equal to or greater than 4. In this case, the connector housing comprises (N−1) partition members, (N/2−1) pairs of the (N−1) partition members being formed as (N/2−1) frame parts in the general "⊔" shape and the remained one partition member integrally being formed with the lower housing portion.

In an alternatively embodiment, the connector housing comprises N insertion ports, wherein N is an uneven number being equal to or greater than 5. In this case, the connector housing comprises (N−1) partition members constructed to form (N−1)/2 frame parts.

The connector housing according to the embodiments of the present invention has less structural members. In general, in the connector housing assembling process is simplified, facilitating automatic assembly; the cost of manufacturing the connector housing is reduced by appropriate structure design; high strength and well stability of the connector housing is achieved; easy design and maintenance thereof are achieved. It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle. Although some embodiments of the general inventive concept have been shown and explained, it should be understood by those skilled in the art that these embodiments may be modified without departing from the principle and spirit of the general inventive concept, and the scope of the present invention are defined by the claims and equivalents thereof.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector housing comprising:

an upper housing portion;

a lower housing portion located below the upper housing portion; and at least three partition members located in an inner space defined by the upper housing portion and the lower housing portion to partition the inner space into at least four insertion ports;

wherein at least one pair of the at least three partition members are connected to each other through a connecting plate to form a frame part in a general "U" shape; and the connecting plate is stacked onto a corresponding position of a bottom of the lower housing portion.

2. The connector housing of claim 1, wherein one partition member of the at least three partition members is integrally formed with the lower housing portion, and the frame part is an individual member.

3. The connector housing of claim 2, wherein the upper housing portion and the lower housing portion are integrally formed by bending a single piece.

4. The connector housing of claim 3, wherein each of the partition members has pins to be plugged into a circuit board for mounting the connector housing.

5. The connector housing of claim 4, wherein the upper housing portion comprises:

a first upper housing portion constructed to form a top wall of the connector housing;

a pair of second upper housing portions constructed to form a pair of side walls of the connector housing; and a third upper housing portion constructed to form a rear end wall of the connector housing.

6. The connector housing of claim 5, wherein, the lower housing portion is constructed to form a bottom wall of the connector housing;

the lower housing portion includes a first lower housing portion and a second lower housing portion connected with the pair of side walls of the upper housing portion, respectively; and one of the first and second lower housing portion is connected with one partition member.

7. The connector housing of claim 6, wherein the pair of second upper housing portions is constructed to form a pair of side walls of the connector housing both having pins to be plugged into the circuit board.

8. The connector housing of claim 7, wherein the connector housing is entirely formed from a single piece of blank plate.

9. The connector housing of claim 8, wherein the single piece of blank plate is shaped by one punching process.

10. The connector housing of claim 1, wherein, the connector housing comprises three partition members constructed to partition the inner space into four insertion ports; and two of the three partition members are formed as the frame part in the general "U" shape and the remaining one is integrally formed with the lower housing portion.

11. The connector housing of claim 1, wherein, the connector housing comprises four partition members constructed to partition the inner space into five insertion ports; and the four partition members are formed as two frame parts in the general "U" shape.

12. The connector housing of claim 1, wherein, the connector housing comprises five partition members constructed to partition the inner space into six insertion ports; and two pairs of the five partition members are formed as two frame parts in the general "U" shape and the remaining one partition member is integrally formed with the lower housing portion.

13. The connector housing of claim 1, wherein, the connector housing comprises N insertion ports, wherein N is an even number equal to or greater than 4, and the connector housing comprises (N−1) partition members, (N/2−1) pairs of the (N−1) partition members being formed as (N/2−1) frame parts in the general "U" shape and the remaining one partition member is integrally formed with the lower housing portion.

14. The connector housing of claim 1, wherein, the connector housing comprises N insertion ports, wherein N is an odd number being equal to or greater than 5, and the connector housing comprises (N−1) partition members constructed to form (N−1)/2 frame parts.

* * * * *